United States Patent [19]

Hitchler et al.

[11] 4,111,721

[45] Sep. 5, 1978

[54] STRIP CAST ALUMINUM HEAT TREATMENT

[75] Inventors: Edward Willard Hitchler, Elgin; Albert Joseph Klein, Arlington Heights, both of Ill.

[73] Assignee: American Can Company, Greenwich, Conn.

[21] Appl. No.: 695,425

[22] Filed: Jun. 14, 1976

[51] Int. Cl.[2] ..... C22F 1/04

[52] U.S. Cl. ..... 148/2; 148/11.5 A; 148/12.7 A

[58] Field of Search ..... 148/2, 11.5 A, 12.7 A, 148/12.7 B, 159, 3; 75/138, 139, 140, 141

[56] References Cited

U.S. PATENT DOCUMENTS

| | | | |
|---|---|---|---|
| 3,369,591 | 2/1968 | Welch et al. | 75/139 |
| 3,386,820 | 6/1968 | Jagaciak | 75/139 |
| 3,486,947 | 12/1969 | Pryor et al. | 148/11.5 |
| 3,502,448 | 3/1970 | Anderson et al. | 148/11.5 A |
| 3,505,126 | 4/1970 | Antes | 148/13 |
| 3,560,269 | 2/1971 | Anderson et al. | 148/11.5 |
| 4,000,009 | 12/1976 | Chatfield | 148/2 |
| 4,021,271 | 5/1977 | Roberts | 148/2 |

*Primary Examiner*—W. Stallard

*Attorney, Agent, or Firm*—Robert P. Auber; Ira S. Dorman; Harry W. Hargis, III

[57] ABSTRACT

Continuous strip cast aluminum alloy of relatively high manganese content which is size-reduced suitably thin for conversion into cans and like fabrications is given an anti-galling character for such severe metal working conditions as drawing and ironing in can making and in equivalently difficult operations by heat treatment of the strip product prior to its final cold reduction pass at temperatures in the 900° F. + range for at least about 4 hours.

9 Claims, 2 Drawing Figures

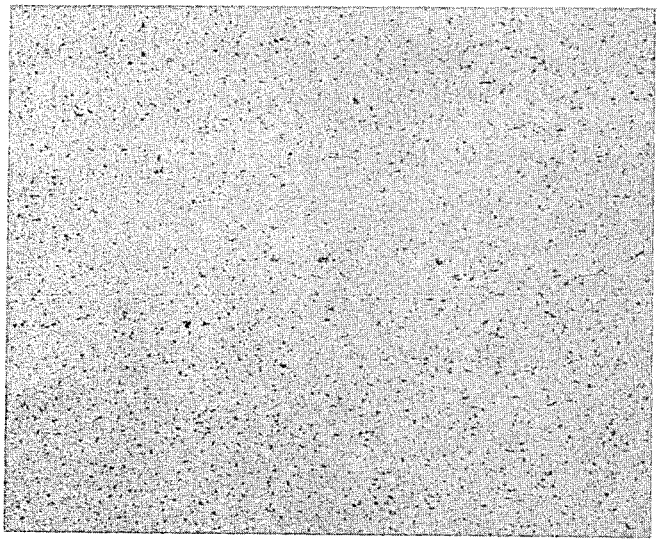
Before Treatment
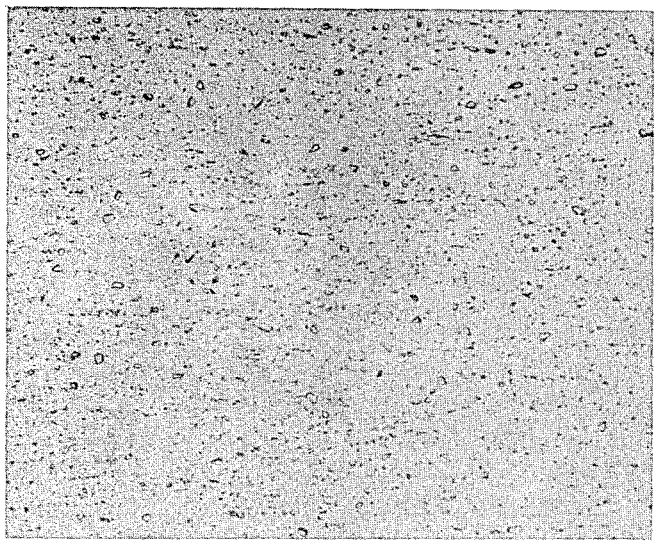
After Treatment

STRIP CAST ALUMINUM HEAT TREATMENT

BACKGROUND OF THE INVENTION

Continuous strip cast aluminum sheet or web material is advantageously utilized for many fabricated products, including components and bodies in and for cans and the like containers. However, such stock invariably has the drawback of not being gall-free when subjected to severe mechanical working conditions, such as drawing and ironing operations in the can making arts, especially in connection with very thin wall constructions. In fact, even utilization of expensive, high film strength lubricants does not preclude or avoid the occurrence of very serious galling in exposure of the sheet to such extreme mechanical conditions. This, of course, disadvantageously limits the utility and applicability of the strip cast aluminum goods.

FIELD AND OBJECTIVES OF THE INVENTION

This invention pertains to a particular heat treating technique for providing strip cast web or sheet products of high manganese-containing aluminum alloys which products are characterized in having outstanding propensity and capability to be gall-free when subjected to severe mechanical working conditions, such as drawing and ironing operations during can making; having the provision of all of same amongst its principal aims and objectives.

PARTICULARIZED DESCRIPTION OF THE INVENTION

According to the present invention, ductile and malleable continuous strip cast aluminum alloy of significant, generally relatively high manganese content is greatly ameliorated and imbued with an outstanding gall-free nature and resistance to surface disruptions upon severe mechanical working thereof by giving the strip casting stock prior to its final cold reduction in the strip casting process a heat soak or heat treatment at a temperature range from about 900° F. to a level just below or almost at the melting point of the alloy for a time period, usually diminishing with increasing or higher treating temperatures, between about 24 hours and about 4 hours. Advantageously, the heat treatment is conducted at a temperature of at least about 1,000° F. for at least about 10 hours. Even more advantageously, it is done in the neighborhood of 1,150° F. for a period of time between about 16 and about 24 hours.

As indicated, the heat treatment is made on the cast alloy strip being cold rolled and size-reduced in the overall strip manufacturing process at any point in the sequence prior to the final cold reduction culmination which imparts desired temper (usually full hard H19 rated) to the desired gauge aluminum alloy sheet product. In this connection and as is widely comprehended, the strip rolling process generally achieves at least an 80–90% reduction in thickness of the cast strip so that in the final reduction stage, besides the H19 temper achieved, the sheet product usually has a tensile strength of at least 40,000 p.s.i., a yield strength of at least 36,000 p.s.i. and at least 2% elongation measured on 2 inch specimens.

A typical strip casting procedure, as is well known to those skilled in the art, involves initial casting from the melt of from about a 2/10 to 1 inch ingot which is then processed through at least three cold reduction stages with appropriate rolling equipment and associated lower temperature (i.e., generally on the 500°–800° F. range) annealings to induce and improve homogenization and remove segregation in the alloy until the final cold reduced sheet product is obtained which most frequently, although not limited thereto, has a thickness on the order of about 10 to 20 mils, even though product having thicknesses as low as about 6 mils or as great as about 50 mils can also be thereby obtained. Most beneficially and conveniently, the heat treatment of the present invention is performed either after the initial strip casting or after the first series of cold reduction steps.

Surprising and unexpectable as it may appear, practice of the present invention makes for a peculiar and very important change in the microstructure or morphology of the alloy material which is heat treated. What occurs, as is indicated in the photomicrographic replications (made on a 3004 aluminum alloy at a 500X magnification per a Keller's etch technique) set forth in the accompanying Drawing, is that secondary constituents in the aluminum alloy are caused to undergo a precipitation growth phenomenon whereby they increase dramatically in size as they occur in the alloy matrix. The net effect of this is that the increased size of the secondary constituents (which are believed to be at least substantially comprised of either $FeMnAl_6$ and/or $MnAl_6$) permits these accreted constituents to function and act as anti-seizing and gall-preventing bearings or load-carrying foci, as it were, for the strip cast stock during harsh and exceedingly rigorous mechanical working thereof as in drawing and ironing operations in a thin-wall can making process of the well known type. As a result, the body of the sheet stock is not galled or torn and possible subsequent fractures and ruptures in the article being produced (such as a can) from the converted sheet stock are precluded and avoided.

In actuality, the average size of the grains or precipitate or secondary constituents in the manganese rich aluminum alloys beneficiated in accordance with the practice of the present invention is generally at least doubled upon measure of the preponderance (i.e., at least about 90%) of the reckonable particles by such techniques as photomicrography of etched samples. More often, the substantial if not almost entire content of included, secondary constituents in alloy materials treated pursuant to the invention is increased in size by at least 3–4 times to as much as 15 to 150 times according to accurate micron measurement thereof. In this connection, a typical actual precipitated particle size before treatment in a Type 3004 aluminum alloy is generally on the order of between about 0.1 and about 1 micron, with the articles of secondary constituents in the same alloy treated according to the present invention in the fresh cast ingot stage by heat soaking for 24 hours at 1150° F. being increased on the average of from about 2 to as much as about 15 microns. Actually, 10–15 or so micron particle size is quite advantageous to obtain from the heat treatment, it generally being accomplished with longer periods of the treatment. In some cases, however, it is suitable for the particle size of the secondary constituents to be between about 2 and about 3 microns. In this connection and as is above-indicated, the preponderance of the secondary constituent particles tends to be of about the same relatively uniform particle size after the heat treatment, although there is some randomness to this.

Equivalent particle size increases are obtained with treatment of other manganese rich aluminum alloys in practice of the invention as well as with Type 3004 and others at different heat soak conditions within the purview of the invention.

In any event, the enlarged constituents in the treated alloy matrix are then quite capable of providing the advantageous load-bearing function to render a highly desirable and particularly useful gall-free product with which material scraping or peeling and surface roughening or galling, as well as localized welding effects, are not encountered during severe and heavy contact working in the course of conversion and fabrication procedures.

As noted, the present invention may advantageously be practiced with any manganese rich strip cast aluminum alloy. Generally, these are those that on a total composition weight basis contain at least about 0.4 wt. % of manganese in the solid solution alloy and, more often, at least about 0.6 wt. % of the manganese constituent. As much as 2 wt. % of manganese may actually be in the alloy. Other components in the contemplated alloys generally include: silicon (in proportions up to about 0.8 wt. %); iron (in amounts up to about 0.8 wt. %); copper (included up to about 0.1 to 0.3 wt. %); magnesium (in quantities of from 0 to 2.5 wt. %); and zinc (on an order of up to about 0.4 wt. %), with the balance of the composition being aluminum. Of course, other ingredients such as boron, chromium and titanium may also be present in the alloys in relatively trace amounts as on the order of several hundred thousandths of a wt. % or less. These additaments, as is known, tend to have profound effects on grain sizes in the involved alloy.

Good illustrations of the manganese rich aluminum alloys that are especially well adapted for utilization in the practice of the present invention include those known in the trade as Types 3003 and 3004. Specific composition limits for these are as follows (with all quantities on a wt. % of total composition weight basis):

| Ingredient | Type 3003 | Type 3004 |
|---|---|---|
| Silicon | 0.60 max. | 0.30 max. |
| Iron | 0.70 max. | 0.70 max. |
| Copper | 0.20 max. | 0.25 max. |
| Manganese | 1.0/1.5 | 1.0/1.5 |
| Magnesium | — | 0.8/1.3 |
| Zinc | 0.10 max. | 0.25 max. |
| Aluminum | Balance | Balance |

Very advantageously and of obviously great benefit, the aluminum alloy involved in the strip casting operation can be composed of partially or completely reclaimed and recycled materials.

Numerous experimentations have shown that given the same strip cast, manganese rich aluminum alloy sheet product for conversion into standard drawn and ironed, two-piece beverage and beer container bodies, the sheet stock prepared in accordance with the present invention was entirely workable without evidence of galling or fractures in the can bodies produced whereas untreated stock could not be satisfactorily utilized for the purpose. In fact, untreated stock invariably failed completely during the ironing procedure.

Many changes and modifications can readily be made and adapted in embodiments in accordance with the present invention without substantially departing from its apparent and intended spirit and scope, all in pursuance and accordance with same as it is set forth and defined in the hereto appended Claims.

What is claimed is:

1. A process for rendering suitable for drawing and ironing manganese rich aluminum alloy material containing at least about 0.4% manganese which has been formed from the melt into a continuously cast strip, comprising the steps of: heat soaking said material of said cast strip at a temperature in a range from about 900° F to about the melting point of the alloy for a time period of between about 24 to 4 hours to form secondary constituents in the material of such increased grain size as to render it resistant to galling when subjected to drawing and ironing in suitable sheet form; and, following said heat soaking, subjecting said cast strip to at least one cold thickness reduction working to form a relatively thin sheet product of finished gage, of hard temper, and of the recited increased grain size suitable for subjection to drawing and ironing.

2. The process of claim 1, characterized in that said aluminum alloy is selected from the group consisting of 3003 and 3004 aluminum.

3. The process of claim 1, characterized in that said heat soaking is performed on said cast strip.

4. The process of claim 1, characterized in that: said cold reducing is performed as a plurality of successive reductions; and said heat soaking is performed on said strip after the first reduction of the recited plurality of successive reductions.

5. The process of claim 1, characterized in that said heat soaking is performed at a temperature of at least about 1000° F for a period of time of at least about 10 hours.

6. The process of claim 1, characterized in that said heat soaking is performed at a temperature of at least about 1150° F for a period of time of at least about 16 hours.

7. The process of claim 1, characterized in that said cold reducing is performed to produce a material of sheet form having H19 temper, a tensile strength of at least 40,000 p.s.i., a yield strength of at least 36,000 p.s.i., and a two-inch specimen elongation of at least 2% with a thickness between about 10 and about 20 mils.

8. The process of claim 1, and characterized by the further step of converting said finally reduced sheet stock into a container body by drawing and ironing operations.

9. The process of claim 1, and characterized in that grain size of said secondary constituents is between about 2 and about 15 microns.

* * * * *